US009416508B2

(12) United States Patent
Welandson

(10) Patent No.: US 9,416,508 B2
(45) Date of Patent: Aug. 16, 2016

(54) TERMINAL ARRANGEMENT FOR A ROAD RAIL

(75) Inventor: Anders Welandson, Smålandsstenar (SE)

(73) Assignee: AB Varmforzinkning, Smalandsstenar (SE)

( * ) Notice: Subject to any disclaimer, the term of this patent is extended or adjusted under 35 U.S.C. 154(b) by 1034 days.

(21) Appl. No.: 13/510,210

(22) PCT Filed: Nov. 10, 2010

(86) PCT No.: PCT/SE2010/051235

§ 371 (c)(1),
(2), (4) Date: Jul. 24, 2012

(87) PCT Pub. No.: WO2011/062546

PCT Pub. Date: May 26, 2011

(65) Prior Publication Data

US 2012/0280193 A1 Nov. 8, 2012

(30) Foreign Application Priority Data

Nov. 17, 2009 (SE) ..... 0950871

(51) Int. Cl.
*E01F 15/00* (2006.01)
*E01F 15/14* (2006.01)

(52) U.S. Cl.
CPC ..... *E01F 15/143* (2013.01)

(58) Field of Classification Search
CPC ..... E01F 15/0438; E01F 15/143
USPC ..... 256/1, 13.1, 59, 60, 61, 62, 65.14, 256/65.15; 404/6, 9, 10
See application file for complete search history.

(56) References Cited

U.S. PATENT DOCUMENTS

| | | | | |
|---|---|---|---|---|
| 5,044,609 | A * | 9/1991 | Cicinnati et al. | 256/13.1 |
| 5,078,366 | A | 1/1992 | Sicking et al. | |
| 5,797,591 | A * | 8/1998 | Krage | 256/13.1 |
| 5,957,435 | A | 9/1999 | Bronstad | |
| 6,022,003 | A * | 2/2000 | Sicking et al. | 256/13.1 |
| 6,109,597 | A * | 8/2000 | Sicking et al. | 256/13.1 |
| 6,173,943 | B1 | 1/2001 | Welch et al. | |
| 6,220,575 | B1 * | 4/2001 | Lindsay et al. | 256/13.1 |
| 6,244,571 | B1 * | 6/2001 | Reid et al. | 256/13.1 |
| 6,293,727 | B1 * | 9/2001 | Albritton | 404/6 |

(Continued)

FOREIGN PATENT DOCUMENTS

WO WO 00/32878 6/2000

OTHER PUBLICATIONS

International Search Report for International Application No. PCT/SE2010/051235 mailed Feb. 16, 2011.

(Continued)

*Primary Examiner* — Gregory Binda
*Assistant Examiner* — Nahid Amiri
(74) *Attorney, Agent, or Firm* — Merchant & Gould P.C.

(57) ABSTRACT

In a terminal arrangement for a road rail with a rail profile (2) a terminal guiding device (10) is movable along the road rail under the influence of kinetic energy from a vehicle hitting the terminal guiding device. A terminal profile (8), constituting a prolongation of the rail profile (2), extends within the terminal guiding device (10) obliquely down to a ground anchor (4), where it is attached. The terminal arrangement includes a mechanism for deforming the terminal profile (8) and eventually the rail profile (2) and thus for absorbing kinetic energy.

9 Claims, 2 Drawing Sheets

(56) References Cited

U.S. PATENT DOCUMENTS

| | | | | |
|---|---|---|---|---|
| 6,575,434 | B2 * | 6/2003 | Bligh et al. | 256/13.1 |
| 6,715,735 | B2 * | 4/2004 | Bligh et al. | 256/13.1 |
| 6,719,483 | B1 * | 4/2004 | Welandsson | 404/6 |
| 7,182,320 | B2 * | 2/2007 | Heimbecker et al. | 256/13.1 |
| 7,185,882 | B2 * | 3/2007 | Buth et al. | 256/13.1 |
| 7,249,908 | B2 * | 7/2007 | Bergendahl et al. | 404/6 |
| 7,306,397 | B2 * | 12/2007 | Albritton | 404/6 |
| 7,516,945 | B2 * | 4/2009 | Alberson et al. | 256/13.1 |
| 2006/0054876 | A1 | 3/2006 | La Turner et al. | |
| 2009/0272956 | A1 * | 11/2009 | Abu-Odeh et al. | 256/13.1 |

OTHER PUBLICATIONS

Extended European Search Report for EP Application No. 10831874.2 mailed Feb. 11, 2015 (6 pages).

* cited by examiner

TERMINAL ARRANGEMENT FOR A ROAD RAIL

This application is a National Stage Application of PCT/SE2010/051235, filed 10 Nov. 2010, which claims benefit of Serial No. 0950871-4, filed 17 Nov. 2009 in Sweden and which applications are incorporated herein by reference. To the extent appropriate, a claim of priority is made to each of the above disclosed applications.

TECHNICAL FIELD

The present invention relates to a terminal arrangement for a road rail with a rail profile, in which arrangement a terminal guiding device is movable along the road rail under the influence of kinetic energy from a vehicle hitting the terminal guiding device and which is provided with a ground anchor. It also relates to a method for absorbing kinetic energy from a vehicle hitting a terminal arrangement at the end of a road rail.

BACKGROUND OF THE INVENTION

A road rail comprising a rail profile, typically a metal profile, mounted on rail posts can be arranged beside a road for preventing vehicles from leaving the road and thereby enhances the road safety. A vehicle that hits the road rail along its length will normally not be seriously damaged. However, it may be very dangerous to hit the end of such a road rail without any safety measures. A suitably designed terminal arrangement may decrease the damages at a collision between a vehicle and the end of a road rail.

A terminal arrangement as defined above is disclosed in SE-C-513 130. In this design there is a terminal guiding device moving along the rail profile when hit by a vehicle. The terminal guiding device has a deformation device for the rail profile as well as an internal channel for bringing down the deformed rail profile to the ground level, so that the vehicle, gradually braked by the terminal guiding device, can pass over it without being damaged or turned over. There is a wire connection between the end of the rail profile and a ground anchor in line with the road rail.

The main object of the invention is to improve and simplify such a terminal arrangement as defined above. It is hereby of great importance for the safety that possible force components trying to raise the terminal guiding device are obviated and also that the rail profile is brought down to the ground level for obviating further damages to the hitting vehicle.

THE INVENTION

This is according to the invention attained in that a terminal profile, constituting a prolongation of the rail profile, extends within the terminal guiding device obliquely down to the ground anchor, where it is attached, and that means for deforming the terminal profile and eventually the rail profile and thus for absorbing kinetic energy are provided in the terminal guiding device.

The terminal profile may preferably have the same cross sectional shape as the rail profile and be longitudinally slotted in order to enhance its deformation properties. However, it may be possible to have other shapes and appearances of the terminal profile.

A ground attachment is preferably attached to the ground anchor and has a plate, which extends in the direction towards the road rail and to which the terminal profile is attached. The terminal guiding device, which has the general shape of a downwardly open U, can be provided with a cross piece under the plate. By this arrangement the terminal guiding device will be guided initially by the plate for movement along the ground.

The terminal guiding device may also be provided with another cross piece over the plate for deforming the terminal profile and thus absorbing energy. The deformation may be controlled by the position of this cross piece and the distance between the two cross pieces.

The terminal guiding device may be connected by friction force to the ground attachment by means of screw joints. In a rest position the terminal guiding device will hereby be fastened to the ground attachment but will be separated therefrom, when a vehicle hits it with a certain force.

The terminal guiding device may preferably also have a cross piece at an input end for the rail profile, whereas the terminal profile may have an elbow in the terminal guiding device in the vicinity of the input end. Hereby, energy is also absorbed at the input end, and the terminal profile and eventually the rail profile, to which it is attached, will be forced down towards the ground as desired.

A first rail post of the road rail is preferably arranged in the vicinity of the input end of the terminal guiding device in the rest position of the latter, so that it will be hit and brought down to the ground at an early stage after a vehicle has hit the terminal guiding device.

The terminal guiding device is preferably provided with a terminal end portion, which a colliding vehicle hits. It may have a suitable construction for causing as little damage to the vehicle as possible and for preventing upwardly directed forces to occur.

BRIEF DESCRIPTION OF THE DRAWINGS

The invention will be described in further detail below under reference to the accompanying drawings, in which.

DETAILED DESCRIPTION

Figure 1:
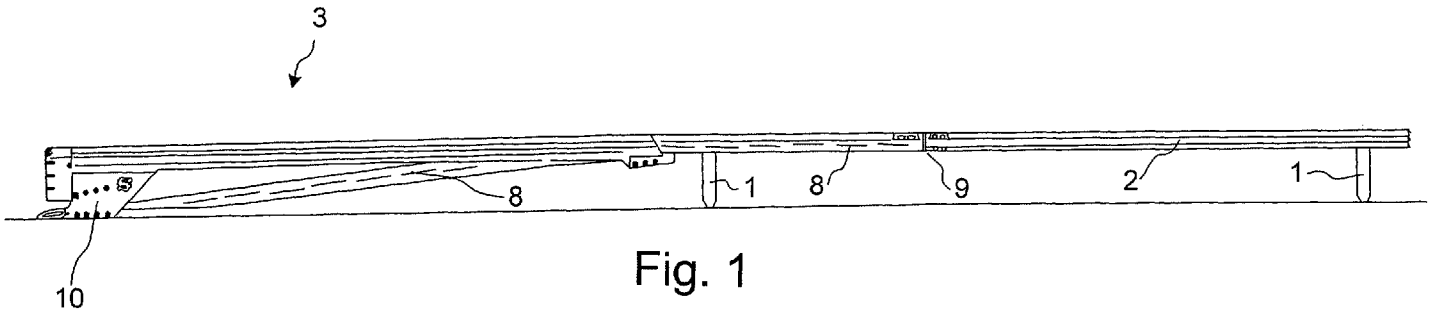
FIG. 1 is a side view of a road rail with a terminal arrangement according to the invention.
Figure 2:
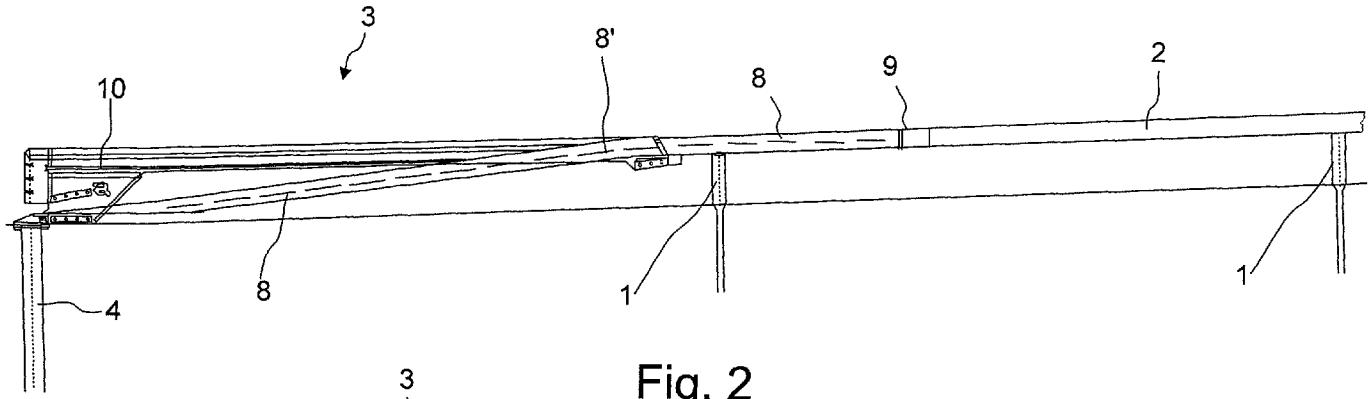
FIG. 2 is a corresponding view, also illustrating ground anchorings for posts of the road rail and for the terminal arrangement.
Figure 3:
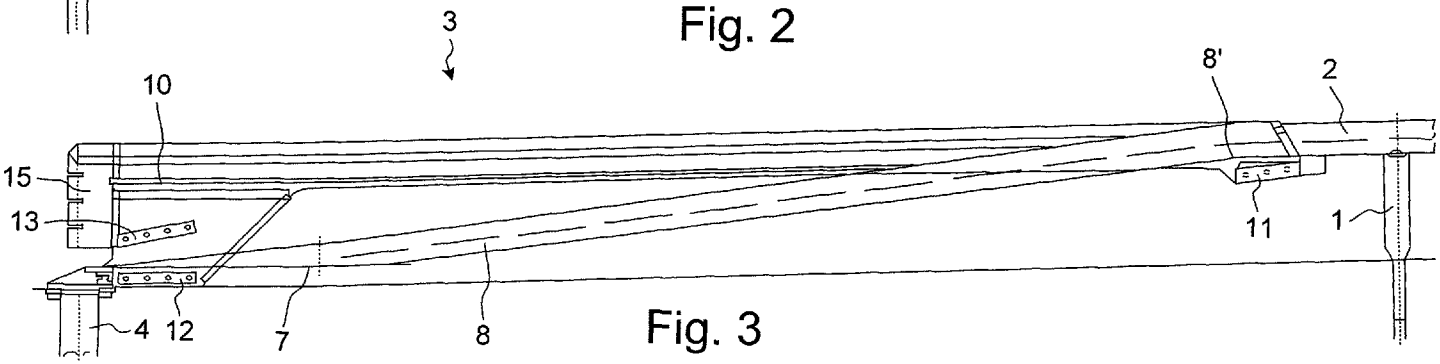
FIG. 3 is a view corresponding to FIG. 2 of the terminal arrangement to a larger scale.
Figure 5:
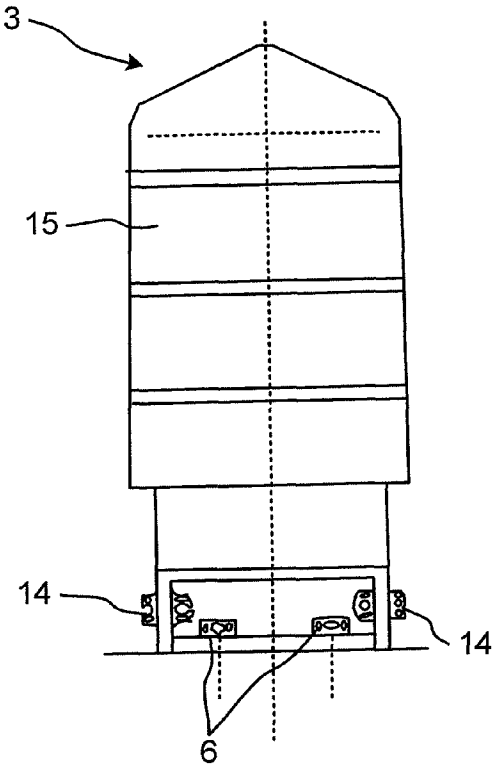
FIG. 5 is an end view of the terminal arrangement.
Figure 4:
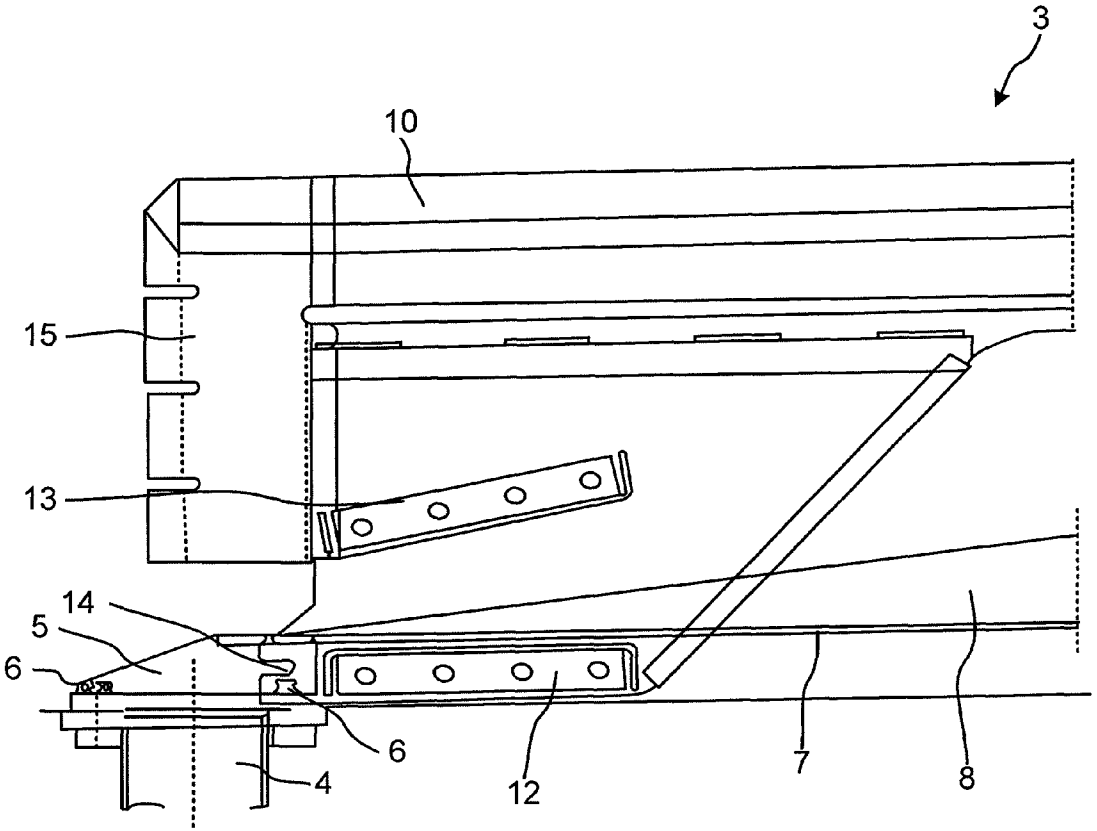
FIG. 4 is a view to an even larger scale of an end portion of the terminal arrangement.

A metal road rail may as shown in FIG. 1 comprise tubular posts I and a rail profile 2 attached to the posts. The rail profile 2 may have a prismatic or ellipsoidal cross sectional shape. Such a road rail is disclosed in the copending Swedish Patent Application No 0801271-8. The posts 1 may as shown in FIG. 2 be anchored in the ground. Their cross-sectional shape may be generally cylindrical, but they are preferably flattened close to the ground, so that they are bent there in a controlled way when exposed to forces generally in the direction of the road rail as a result of a collision with a vehicle on the road.

The invention is concerned with a terminal arrangement 3 for such a road rail. This terminal arrangement 3 provided at the free end of a road rail has the purpose of protecting a vehicle hitting the end of the road rail generally in its longitudinal direction.

A strong ground anchor 4 is provided for the terminal arrangement 3. A ground attachment 5 is attached to this ground anchor 4, preferably by screws 6. The ground attachment 5 has a plate 7 extending in the longitudinal direction towards the road rail.

A terminal profile 8, preferably but not necessarily of the same material and with the same cross-sectional shape as the rail profile 2 is firmly attached to the plate 7 and extends obliquely upwards to an elbow 8' and then in the same direction as the rail profile 2 and is connected to the latter by a joint 9. The terminal profile 8 may be supported by a rail post 1 in the vicinity of the elbow 8'. The distance between this rail post 1 and the joint 9 may be in the order of 2 meters and the distance between neighboring rail posts 1 in the road rail some 6 meters. The terminal profile 8 is preferably longitudinally slotted in order to improve its deformation characteristics.

A terminal guiding device 10 is connected at a first end to the left in the Figures to the ground attachment 5 and extends in the direction of the rail profile 2 over and past the elbow 8' of the terminal profile 8. The longitudinal portion of the terminal guiding device 10 has a downwardly open U-shape.

At its input end for the terminal profile 8 the terminal guiding device 10 is provided with a first cross piece 11, so that a closed opening is created.

Towards its opposite end the downwardly open terminal guiding device 10 is extended down to the ground attachment 5. A second cross piece 12 connects the two legs of the terminal guiding device 10 below the plate 7, and an obliquely arranged, third cross piece 13 connects the two legs of the terminal guiding device 10 over the plate 7. This third cross piece 13 may be regarded as the main means for deforming the terminal profile 8 and thus for absorbing kinetic energy. The position of the third cross piece 13 and its distance to the second cross piece 12 (and thus the plate 7) determines the deformation of the terminal profile 8 and thus the kinetic energy absorbed.

The terminal guiding device 10 is connected to flanges of the ground attachment 5 by means of two screw joints 14 in horizontal open grooves in the legs of the terminal guiding device 10, so that the latter may move to the right in the Figures if exposed to a force exceeding the friction force of the screw joints 14.

At its end to the left in the Figures the terminal guiding device 10 is provided with a terminal end portion 15. A colliding vehicle hits this end portion 15, which is designed in such a way that the hitting vehicle is damaged to a minimum extent. Its design is also such that no upwardly directed forces are generated.

If a vehicle hits the terminal end portion 15 with a certain speed, the terminal guiding device 10 will be freed by the screw joints 14 to move to the right in the Figures along the terminal profile 8 (and later on the rail profile 2). Initially, the plate 7 will guide the movement along the ground. After a short movement the first rail post 1 will be bent down, and the third cross piece 13 will engage the terminal profile 8 and deform it downwards against the plate 7. After further movement the terminal guiding device 10 will also reach the rail profile 2 with its input end. The combined action of the deformation at the third cross piece 13 and at the input end of the terminal guiding device 10, absorbing energy from the vehicle having hit the terminal end portion 15, will lead to decreasing speed of the movement to the right of the terminal guiding device 10. During the movement first the terminal profile 8 and later the rail profile 2 (as well as certain rail posts 1) will be brought down to the ground, and the vehicle having hit the terminal arrangement 3 will move freely over it without being damaged or affected in its movements on its wheels, until it is brought to a standstill.

Modifications are possible within the scope of the appended claims. Especially, it shall be noted that the terminal profile 8 need not be a profile with the same cross sectional shape as the rail profile but may have any other shape and appearance, for example a flat bar or a rod.

The invention claimed is:

1. A terminal arrangement for a road rail having a rail profile, wherein the terminal arrangement comprises:

a terminal guiding device having a proximal end and a distal end and a body extending from the proximal end to the distal end;

a ground attachment attached to a ground anchor and coupled with the distal end of the terminal guiding device wherein the ground attachment-has a plate, extending laterally toward the proximal end of the terminal profile, and wherein the distal end of the terminal profile is directly attached to the plate, and, wherein the distal end of the terminal guiding device is positioned directly above the ground anchor; and a terminal profile having a proximal end and a distal end, wherein the terminal profile extends within the terminal guiding device obliquely down to the ground anchor, wherein the distal end of the terminal profile is attached to the ground attachment;

wherein the proximal end of the terminal profile is coupled with and extends from an end of the rail profile, and wherein the terminal guiding device is movable along the terminal profile and is capable of absorbing kinetic energy by deforming the terminal profile and the rail profile upon impact.

2. The terminal arrangement according to claim 1, wherein the terminal profile is longitudinally slotted.

3. The terminal arrangement according to claim 1, wherein the body of the terminal guiding device has a cross sectional shape and orientation of a downwardly open U and wherein the terminal guiding device comprises adjacent the distal end a first leg extending downward on a first side of the body and a second leg extending downward on a second side of the body, wherein the distal end of the terminal profile is disposed between the first leg and the second leg of the terminal guiding device, and wherein the terminal guiding device comprises a first cross piece connecting the first leg and the second leg under the plate and under the distal end of the terminal profile.

4. The terminal arrangement according to claim 3, wherein the terminal guiding device comprises a second cross piece connecting the first leg and the second leg below the body and over the plate for deforming the terminal profile.

5. The terminal arrangement according to claim 4, wherein the terminal guiding device is connected by friction force to the ground attachment by means of screw joints.

6. The terminal arrangement according to claim 1, wherein the terminal guiding device has a cross piece at the proximal end of the terminal guiding device.

7. The terminal arrangement according to claim 6, wherein the terminal profile has an elbow disposed within the terminal guiding device adjacent to the proximal end of the terminal guiding device.

8. The terminal arrangement according to claim 1, wherein a first rail post is arranged adjacent to the proximal end of the terminal guiding device.

9. The terminal arrangement according to claim 1, wherein the terminal guiding device comprises a terminal end portion adjacent to the distal end of the terminal guiding device.

* * * * *